US008250883B2

(12) United States Patent
Migliore et al.

(10) Patent No.: US 8,250,883 B2
(45) Date of Patent: Aug. 28, 2012

(54) PROCESS TO OBTAIN LIQUEFIED NATURAL GAS

(75) Inventors: Calogero Migliore, Madrid (ES); Silvia Pérez Díaz, Gijón (Asturias) (ES); Giorgio Soave, Milan (IT)

(73) Assignee: Repsol YPF, S.A., Madrid (ES)

( * ) Notice: Subject to any disclaimer, the term of this patent is extended or adjusted under 35 U.S.C. 154(b) by 1478 days.

(21) Appl. No.: 11/645,162

(22) Filed: Dec. 26, 2006

(65) Prior Publication Data

US 2008/0148770 A1 Jun. 26, 2008

(51) Int. Cl.
*F25J 1/00* (2006.01)

(52) U.S. Cl. ..... 62/612; 62/611

(58) Field of Classification Search ..... 62/611, 62/612, 623

See application file for complete search history.

(56) References Cited

U.S. PATENT DOCUMENTS

| | | | | |
|---|---|---|---|---|
| 4,274,849 | A * | 6/1981 | Garier et al. | 62/612 |
| 4,846,862 | A * | 7/1989 | Cook | 62/48.2 |
| 5,267,449 | A * | 12/1993 | Kiczek et al. | 62/86 |
| 6,119,479 | A * | 9/2000 | Roberts et al. | 62/612 |
| 6,170,264 | B1 * | 1/2001 | Viteri et al. | 60/671 |
| 6,266,977 | B1 * | 7/2001 | Howard et al. | 62/623 |
| 6,289,692 | B1 * | 9/2001 | Houser et al. | 62/613 |
| 6,560,989 | B1 * | 5/2003 | Roberts et al. | 62/623 |
| 6,672,104 | B2 * | 1/2004 | Kimble et al. | 62/613 |
| 6,915,661 | B2 * | 7/2005 | Le Bot | 62/611 |
| 2004/0255616 | A1 * | 12/2004 | Maunder et al. | 62/611 |

* cited by examiner

*Primary Examiner* — Marc Norman
*Assistant Examiner* — Filip Zec
(74) *Attorney, Agent, or Firm* — Gardner Groff Greenwald & Villanueva, PC

(57) ABSTRACT

A process to obtain liquefied natural gas (LNG) which comprises the use of air as refrigerant in an open or closed cycle. The invention also refers to a system to carry out said process and uses thereof.

19 Claims, 3 Drawing Sheets

PROCESS TO OBTAIN LIQUEFIED NATURAL GAS

The invention relates to a process to obtain Liquefied Natural Gas (LNG) using air as refrigerant. This process can be performed by using an open or close air refrigerant cycle.

BACKGROUND ART

Natural gas is often available in areas remote from where it will be ultimately used. When carrying it, natural gas is cooled to a temperature of approximately −260° F. (−160° C.) at atmospheric pressure so that it condenses to a liquid called liquefied natural gas (LNG). This LNG is normally transported overseas in appropriate carrier vessels.

Numerous process cycles have been developed for LNG production to provide the large refrigeration requirements. Such cycles typically use a mixed refrigerant comprising light hydrocarbons and optionally nitrogen. e.g., U.S. Pat. No. 4,274,849 patent discloses a mixture of hydrocarbons, at least two, as a refrigerating fluid in a process to liquefy a natural gas.

SUMMARY OF THE INVENTION

The present invention refers to a novel process, system or plant capable of liquefying natural gas from any kind of natural gas fields, and particularly from "offshore" fields, and more particularly from stranded natural gas fields, wherein this process comprises air used as refrigerant.

The system of the present invention comprises a simple and easily reproducible process in all possible locations, preferably "offshore" natural gas fields. This system is particularly advantageous when located in barges for liquefying gas from small natural gas fields located in distant areas, far away from the coast.

Thus, a first aspect of this invention refers to a process to obtain liquefied natural gas which comprises the air used as refrigerant. This process can be developed as an air refrigeration cycle independent from the natural gas stream.

According to the process of the present invention, it is provided an air refrigeration cycle comprising the following steps:

a. compressing the air b. cooling said compressed air of step (a)

c. expanding said compressed air once cooled at step (b); and d. using said expanded air (step (c)) for cooling natural gas In an embodiment of the present invention, the process can also comprise the further step:

e. adding an air make-up in order to compensate the probable air losses.

The air make-up may be treated to remove the $CO_2$ and water that can be carried using treating facilities known in the art.

In a more preferred embodiment, step (a) of the process is carried out in at least one stage, preferably more than one.

The air refrigerant cycle of the invention can be open or closed. When the air refrigeration cycle is open, the air is continuously taken from the environment, at atmospheric conditions, treated to remove $CO_2$ and water, used to cool natural gas according to the above steps, and given back to the atmosphere.

When the air refrigeration cycle is closed, the air used to cool natural gas goes back to the beginning of the process (step (a)).

According to the process of the present invention, the natural gas stream passes through the following steps:

a. cooling the natural gas.

b. expanding said natural gas once cooled at step (a), obtaining LNG or LNG and a vapour phase (endflash gas).

Thus, the natural gas can be liquefied completely (LNG), without letting any vapor phase, or not obtaining two phases, liquid and vapor.

In another embodiment of the present invention, if two phases are obtained in step (b), the natural gas stream comprises the further step:

c. separating said phases: liquid (LNG) and vapor (endflash gas).

Optionally, the natural gas stream may further comprise the stage of separating their natural gas liquids (NGL), before liquefaction.

The term "Natural gas liquids (NGL)" as used herein refers to less volatile components of the natural gas, from ethane to higher hydrocarbons (ethane, propane, butane, isobutane and natural gasoline, the latter sometimes called condensate), with minor content of methane.

In another embodiment of the present invention, the natural gas stream can be pre-treated, if required, before cooling it. Various pretreatment arrangements are known in the art. The appropriate pretreatment depends on the location, the type, the precise composition and the level and nature of undesirable contaminants or impurities present in the natural gas feed. It usually could comprise the removal, but are not limited to, Hg, $H_2O$, $CO_2$ or $H_2S$.

This natural gas stream is often passed to the process with a pressure of at least 1 bar, and preferably above 10 bar; it also depends on the location, and the type of the natural gas in the gas-field.

The feed of natural gas can be poor in heavier hydrocarbons and it needs no separation of the natural gas liquids; alternately, should the natural gas is partially rich in heavier hydrocarbons, the natural gas liquids can be kept in the final LNG and separated by fractionation after its transportation to the final destination. In both cases the natural gas is liquefied as such and this is realized using a single heat exchanger.

In a more preferred embodiment, a natural gas stream particularly rich in heavier hydrocarbons is cooled in two stages:

First, the natural gas is cooled with air, until a suitable temperature that allows condensing as a liquid the required quantity of natural gas liquids (NGL). This stage is carried out through a first heat exchanger. This temperature could depend on the natural gas feed composition, LNG specifications, or on particular requirements in heavier components recoveries and/or purities. This temperature will not be lower than −100° C.

The result of the previous stage is a light hydrocarbon gaseous stream called lean natural gas. The term "lean natural gas" refers to a stream which contains almost all the methane and the nitrogen of the initial feed, the desired quantity of ethane and small residual quantities of the less volatile components (propane and higher).

Secondly, the lean natural gas goes through a second heat exchanger where it is cooled with the air, until the gas is almost totally or fully liquefied. The temperature at which the NG exits this heat exchanger will not be lower than −163° C.

As an alternate embodiment, the cooling and liquefaction of a natural gas stream particularly rich in heavier hydrocarbons can be carried out in only one heat exchanger. In this case, the NGL extraction is done after the gas pretreatment and before the cooling and liquefaction.

In another embodiment of the invention, the endflash gas stream, obtained as subproduct in the liquefying of natural gas, is used to cool natural gas and air streams in the process in order to recover its cryogenic energy, and as fuel gas. This fuel could feed gas turbines and it will typically need to be pressurized by a compressor before being introduced to them. The amount of endflash gas obtained can match the quantity of required fuel gas or it can be part of it or it can be in excess and be used partly for other purposes.

A second aspect of the present invention refers to a system to carry out the previously described process which comprises a continuous stream of natural gas, gas treatment facilities and an air refrigerant cycle.

Air is used as refrigerant in the refrigerant cycle of this system in order to obtain liquefied natural gas. This cycle can preferably be closed loop or open cycle.

In other embodiment, the system comprises the following pieces of equipment:

- Heat exchangers. Any type of heat exchangers may be used in the present invention, although plate-fin heat exchangers are preferred. The minimum number of heat exchangers in the natural gas side is one, although any number of heat exchangers is possible.
- In an embodiment of the present invention, the system can have the exchange of heat between the compressed air stream and the exhaust air after cooling and liquefaction in a separate heat exchanger.
- Expanders. Examples of suitable expanders are a JT-valve (Joule Thompson valve) and a turbine expander, although any type of expander may be employed.
- In the air side, at least one expander is necessary for air expansion. Due to power limitations, the air expanders can be more than one in parallel. The air expanders can be coupled to one or more air compressors in order to recovery their power. Alternately, their power can be utilized for other process purposes, such as power generation.
- In the natural gas side, at least one expander is necessary for expanding the liquid obtained from the heat exchange section.
- Compressors. At least one is required for compressing the air. The number of compression stages in the air cycle depends on the process optimization; it is not a fixed number.
- The compression zone preferably comprises one or more heat exchangers (intercoolers) between compressors, in case more than one compressor is used, and one or more heat exchangers (aftercoolers) after the last compressor. The intercoolers and the aftercoolers preferably use water as coolant medium, although air can also be used. Shell-and-tube heat exchangers are preferred.
- Another compressor, together with its cooling system, may be required to feed the gas turbines with the endflash gas.
- Compressor drivers. They drive all of the compression stages, except for one if it is coupled to the air expander. Gas turbines or electric motors can be used.

In a more preferred embodiment, the system comprises further equipment:

- Column for NGL extraction. If an NGL fractionation is required, more than one column could be necessary. The column for NGL extraction can be bypassed if no natural gas liquids need to be extracted, so in this case, the natural gas stream can be directed to a further heat exchanger for the liquefaction of natural gas.

In a still preferred embodiment, the system comprises further equipment:

- Endflash vessel.

On a second embodiment of the present invention, this system may be located on a fixed structure such as a platform or a movable structure such as a barge or a ship. Both structures may be used in all types of natural gas fields, including onshore and offshore gas fields. This allows the exploitation in any kind of deposit, even for exploitation of stranded gas (small volume and remote area fields).

The term "onshore" as used herein refers to something that is on land.

The term "offshore" as used herein refers to something that is in the sea away from the shore; not on the shoreline but out to the sea.

As an alternate embodiment, the system can be located on two separate areas (two different fixed structures, two different movable structures or one fixed structure and one movable structure). One area may be dedicated to the gas pretreatment unit and the NGL extraction facilities, while the other area may be dedicated to the liquefaction unit.

Thus, a third aspect of this invention refers to the use of the system previously described for natural gas fields, and preferably for stranded natural gas fields.

The term "stranded natural gas field" as used herein refers to a natural gas field that has been discovered, but remains unusable for either physical or economic reasons. Economically, because the reserve is too remote from a market for natural gas; or physically, if the gas field is too deep to drill for, or is beneath an obstruction.

Another aspect of this invention relates to the use of the previously described system for producing at least 0.1 MTA (million tonnes per year) of LNG, and preferably, the production of LNG is within the range of 0.5 to 3 MTA.

Unless otherwise defined, all technical and scientific terms used herein have the same meaning as commonly understood by one of ordinary skilled in the art to which this invention belongs. Methods and materials similar or equivalent to those described herein can be used in the practice of the present invention. Throughout the description and claims the word "comprise" and its variations are not intended to exclude other technical features, additives, components, or steps. Additional objects, advantages and features of the invention will become apparent to those skilled in the art upon examination of the description or may be learned by practice of the invention. The following examples and drawings are provided by way of illustration and are not intended to be limiting of the present invention. Various required subsystems such as valves, control systems, sensors, clamps, and riser support structures have been deleted from the Figures for the purposes of simplicity and clarity of presentation.

EXAMPLES

The following examples give a description of some of the possible process schemes and operating conditions which do not cover all the possible schemes and conditions which are detailed in the claim list given below.

Example 1

Figure 1:
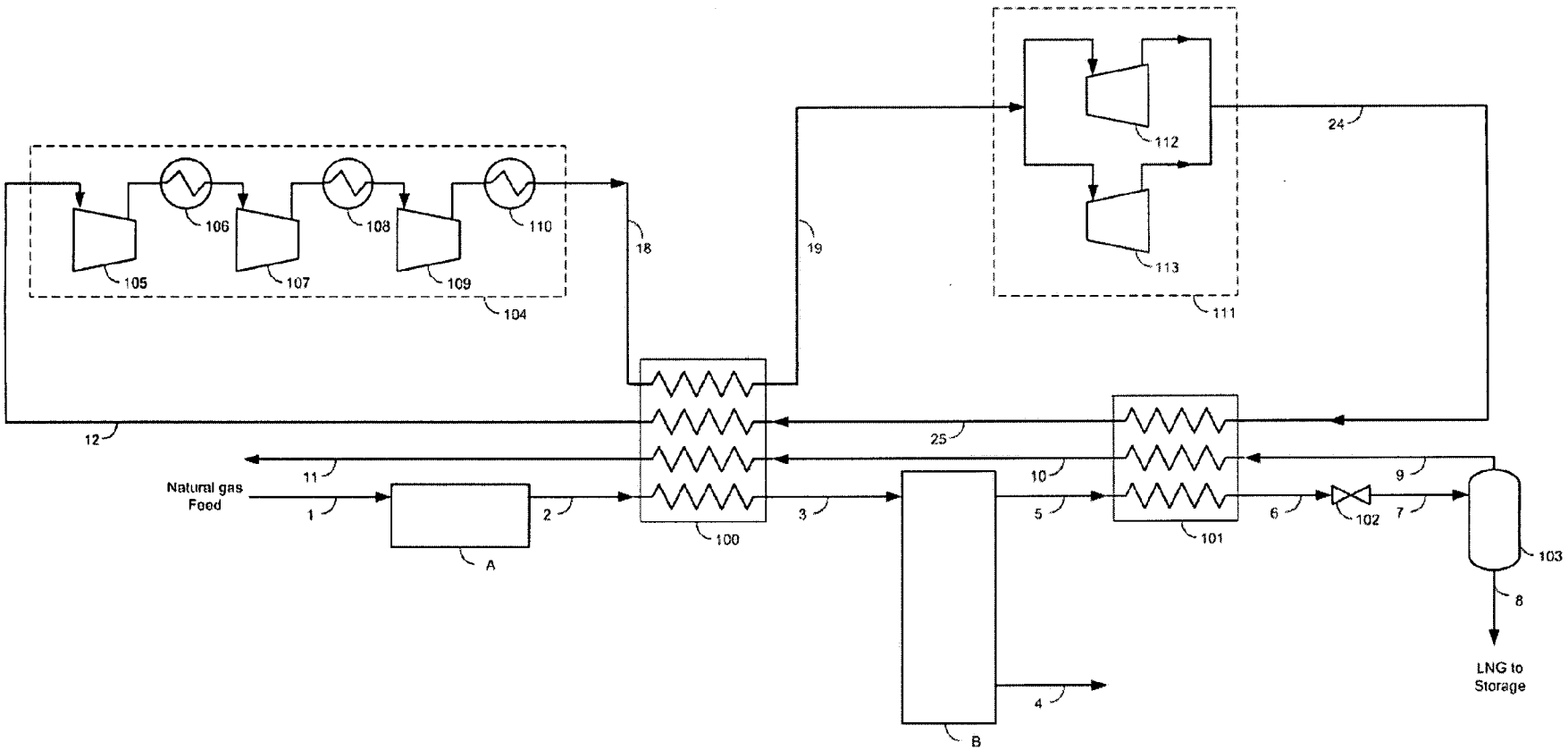
FIG. 1 and FIG. 3.—are schematic diagrams of a closed refrigerant cycle according to the invention.

FIG. 1 shows one example of the present invention as applied to liquefaction of a natural gas feed stream using air as refrigerant. The natural gas feed stream 1 is treated in a conventional pretreatment plant A to remove $CO_2$, $H_2S$, water and mercury contaminants.

The treated gas, stream 2, corresponds to a sweet, dry natural gas stream at 15° C., 30 bar. Stream 2 has a molar composition as given in Table 1 below.

TABLE 1

Treated gas composition example

| Component | Mole Fraction |
|---|---|
| Nitrogen | 0.0020 |
| Methane | 0.8387 |
| Ethane | 0.1204 |
| Propane | 0.0274 |
| n-Butane | 0.0081 |
| n-Pentane | 0.0034 |

Stream 2 enters the liquefaction plant, passing through two heat exchangers 100, 101 in order to obtain a subcooled high pressure liquid, stream 6. In the first heat exchanger 100, the natural gas is precooled to an intermediate temperature of about −69° C. (stream 3), in order to condense the natural gas liquids. Stream 3 enters a column B where the natural gas liquids are extracted as stream 4 at the bottom, while the lean gas, stream 5, exits the column at the top. Stream 4 will be directed to a fractionation zone, if specific products like propane and butane are required.

The lean natural gas (stream 5) enters the second heat exchanger 101, and it is cooled to a temperature of about −130° C., obtaining a subcooled high pressure liquid stream (stream 6), which is directed to a JT-valve 102, through which the stream 6 is expanded adiabatically to 1.1 bar and finally directed to an endflash vessel 103, which separates liquid and vapor, producing LNG to storage (stream 8) and endflash gas (stream 9), both at about −160° C. and 1.1 bar.

Stream 9 is passed back to both heat exchangers 101 and 100, respectively, where the cryogenic energy of this stream is recovered. Thus, stream 9 exits the heat exchanger 101 at −91° C., obtaining stream 10, which is further heated by heat exchanger 100 to the temperature of 15° C. (stream 11). This vapor stream 11 can be used as fuel within the plant. In case this fuel feeds gas turbines, stream 11 will typically need to be pressurized by a compressor before being introduced to them.

In this example, the heat exchangers in the natural gas side are plate-fin heat exchangers.

The air refrigeration cycle which transforms gas stream 2 to liquid stream 6 will now be described, starting with air stream 12 which has been exhausted of all or most of its cooling properties by absorbing heat from the feed gas. Stream 12, at about 34° C., is at the lowest pressure of the cycle (about 2 bar) and is fed to and recompressed in a multistage compressor unit 104 provided with intercooling and aftercooling stages to produce compressed stream 18. The compressor zone comprises three compressors 105, 107 and 109, with one heat exchanger 106 between compressors 105 and 107, one heat exchanger 108 between compressors 107 and 109 and one heat exchanger 110 after the last compressor 109. The intercoolers 106 and 108, and the aftercooler 110 use water as coolant medium. Compressed stream 18 exits the compressor unit 104 at 40° C., 30 bar and is directed to heat exchanger 100, where is precooled to −24° C. by the countercurrent passage of air refrigerant stream 21 and of endflash gas 10. Stream 18 emerges as stream 19 from heat exchanger 100 and is passed to an expander zone 111 to reduce the pressure and temperature of the air stream 19, resulting in the stream 24. The expander zone comprises two turboexpanders 112 and 113 in parallel and is used to provide part of the power for the compressors of the compressor unit 104. The air stream 24 (which has been expanded in the expander zone 111) is at 2.1 bar and at a temperature of about −135° C. It passes through both heat exchangers 101 and 100, respectively. In the heat exchanger 101, the stream 24 provides enough cooling to liquefy the natural gas stream 5 to form liquid natural gas (stream 6). Stream 24 emerges as stream 25 from heat exchanger 101 at a temperature of −73° C. and it enters heat exchanger 100, where it precools both the natural gas (stream 2) and the compressed air (stream 18). Stream 25 leaves the heat exchanger 100 as stream 12 and it starts the cycle again.

The air cycle will have a point for make up in order to compensate for air losses in the air cycle. The air make-up will have to be treated in treating facilities to eliminate the $CO_2$ and water that it can carry.

Table 2 shows the operating conditions of the main streams of FIG. 1.

TABLE 2

| Stream | P (bar) | T (° C.) |
|---|---|---|
| 2 | 30 | 15 |
| 3 | 29.8 | −68.6 |
| 5 | 29.8 | −68.6 |
| 6 | 29.6 | −130.4 |
| 7 | 1.1 | −159.4 |
| 8 | 1.1 | −159.4 |
| 9 | 1.1 | −159.4 |
| 10 | 1.05 | −90.8 |
| 11 | 1 | 15 |
| 12 | 1.95 | 34.5 |
| 18 | 30 | 40 |
| 19 | 29.9 | −24.1 |
| 24 | 2.15 | −134.6 |
| 25 | 2.05 | −73.4 |

Example 2

Figure 2:
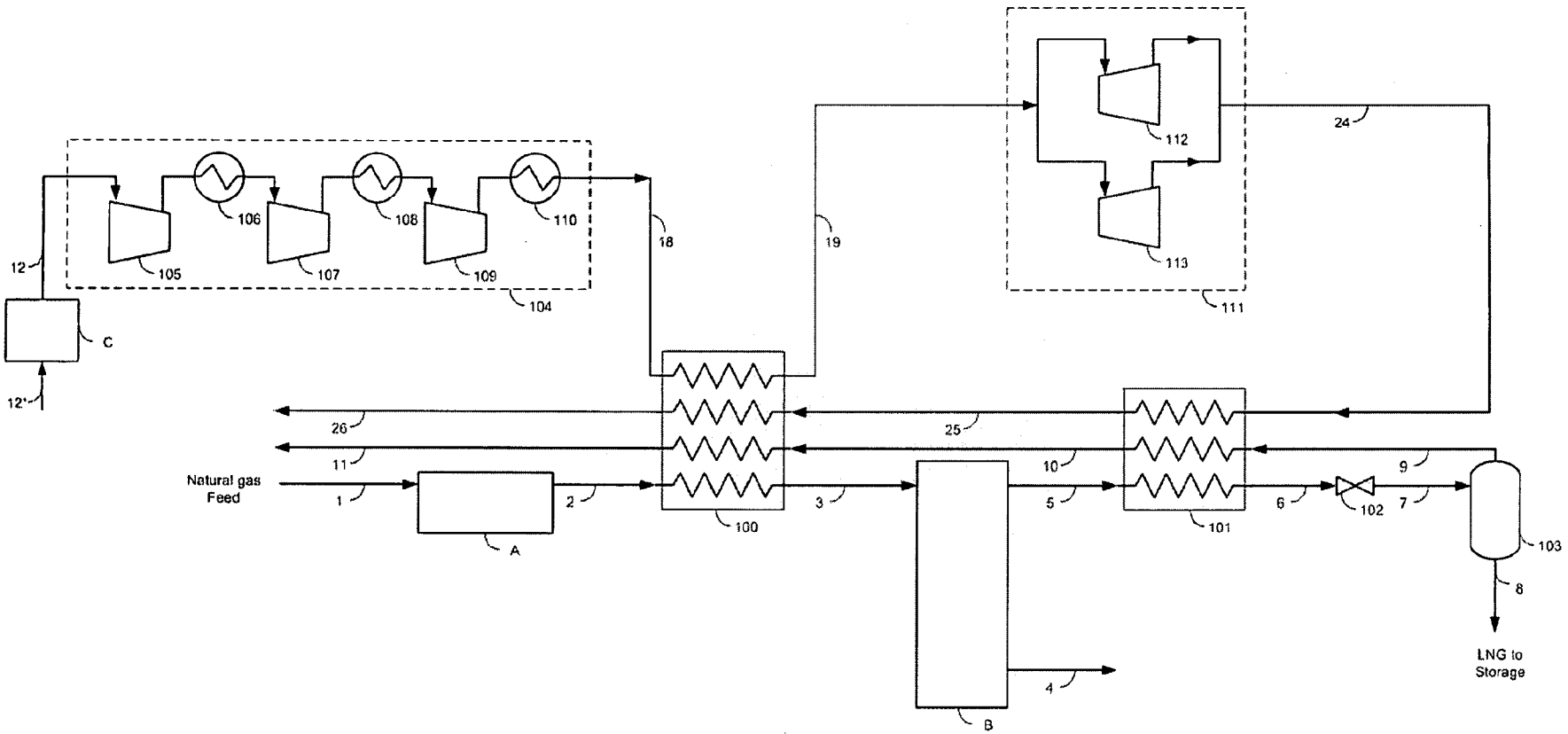
FIG. 2.—is a schematic diagram of an open refrigerant loop according to the invention.

FIG. 2 shows another example of the present invention. The example shown in FIG. 2 has, as modification in relation to FIG. 1, that the air used as refrigerant flows in an open loop.

As in the previous example, the natural gas 1 is treated in the pretreatment plant A to remove $CO_2$, $H_2S$, water and mercury contaminants (the treated gas, stream 2, has the composition shown in Table 1) and then liquefied by exchange with cold air in two steps. First, it is precooled in the heat exchanger 100 to a temperature of about −69° C. (stream 3). It passes through a column B where the liquids are extracted as the bottom stream 4; the lean natural gas exits the column B at the top (stream 5) and enters the second heat exchanger 101. The liquid stream emerging from heat exchanger 101 at about −130° C. (stream 6) is directed to an expansion zone, where is expanded adiabatically in a JT-valve 102 to 1.1 bar (stream 7). Finally, stream 7 is directed to an endflash vessel 103, which separates liquid and vapor, producing LNG to storage (stream 8) and endflash gas (stream 9), both at about −160° C. and 1.1 bar.

Stream 9 is passed back to both heat exchangers 101 and 100, respectively, where the cryogenic energy of this stream is recovered, in an identical way as in Example 1. In the end, endflash gas exits heat exchanger 100 as stream 11 at 15° C., 1 bar. This vapor stream 11 can be used as fuel within the plant.

The air refrigeration cycle, in FIG. 2, is an open loop. In this cycle, the air is continuously taken from the atmosphere at ambient conditions (stream 12*). Stream 12* enters the treating plant C, which is in charge of removing the $CO_2$ and water that can carry the air and leaves the plant as stream 12 (15° C., 1 bar). Stream 12 is compressed in a multistage compressor unit 104 provided with intercooling and aftercooling stages to produce compressed stream 18, which exits the compressor unit 104 at 40° C. and 16 bar. It is directed to heat exchanger 100, where is precooled to about −27° C. by the countercurrent passage of air refrigerant stream 21 and of endflash gas 10. Stream 18 emerges as stream 19 from heat exchanger 100 and is passed to an expander zone 111, where the pressure and the temperature is reduced to about 1.2 bar and −133° C., respectively (stream 24). Stream 24 passes through both heat exchangers 101 and 100, respectively. In the heat exchanger 101, the stream 24 provides enough cooling to liquefy the natural gas stream 5 to form liquid natural gas (stream 6). Stream 24 emerges as stream 25 from heat exchanger 101 at a temperature of about −74° C. and it enters heat exchanger 100, where it precools both the natural gas (stream 2) and the compressed air (stream 18). Stream 25 leaves the heat exchanger 100 as stream 26 at about 33° C. and 1 bar, and it is released directly to the atmosphere.

Table 3 shows the operating conditions of the main streams of FIG. 2.

TABLE 3

| Stream | P (bar) | T (° C.) |
|---|---|---|
| 2 | 30 | 15 |
| 3 | 29.8 | −68.6 |
| 5 | 29.8 | −68.6 |
| 6 | 29.6 | −130.4 |
| 7 | 1.1 | −159.4 |
| 8 | 1.1 | −159.4 |
| 9 | 1.1 | −159.4 |
| 10 | 1.05 | −90.8 |
| 11 | 1 | 15 |
| 12 | 1 | 15 |
| 18 | 16 | 40 |
| 19 | 15.9 | −26.7 |
| 24 | 1.2 | −133.1 |
| 25 | 1.1 | −74.1 |
| 26 | 1 | 33.3 |

Example 3

Figure 3:
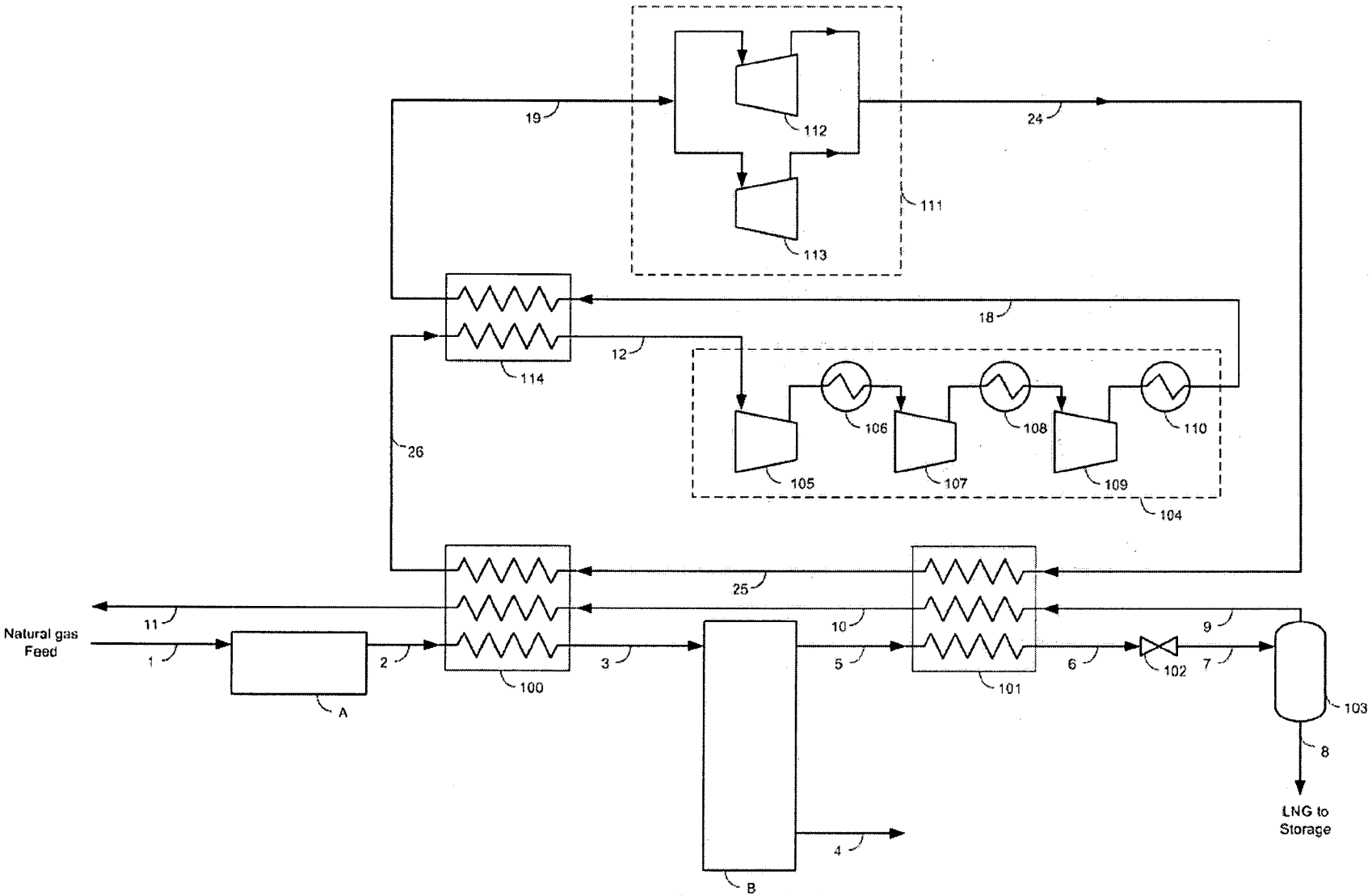

FIG. 3 shows another example of the present invention.

As in the previous examples, the natural gas 1 is treated in the pretreatment plant A (the treated gas, stream 2, has the composition shown in Table 1) and then liquefied by exchanging heat with cold air in two steps. First, it is precooled in the heat exchanger 100 to a temperature of about −69° C. (stream 3). It passes through a column B where the liquids are extracted as the bottom stream 4; the lean natural gas exits the column B at the top (stream 5) and enters the second heat exchanger 101. The liquid stream emerging from heat exchanger 101 at about −131° C. (stream 6) is directed to an expansion zone, where is expanded adiabatically in a JT-valve 102 to 1.1 bar (stream 7). Finally, stream 7 is directed to an endflash vessel 103, which separates liquid and vapor, producing LNG to storage (stream 8) and endflash gas (stream 9), both at about −160° C. and 1.1 bar.

Stream 9 is passed back to both heat exchangers 101 and 100, respectively, where the cryogenic energy of this stream is recovered, in an identical way as in Examples 1 and 2. In the end, endflash gas exits heat exchanger 100 as stream 11 at 15° C., 1 bar. This vapor stream 11 can be used as fuel within the plant.

The air refrigeration cycle which transforms gas stream 2 to liquid stream 6 will now be described, starting with air stream 12. Stream 12, which is at about 36° C. and 3.6 bar is compressed in a multistage compressor unit 104 provided with intercooling and aftercooling stages to produce compressed stream 18, which exits the compressor unit 104 at 40° C. and 43 bar. It is directed to heat exchanger 114, where is precooled to about −33° C. by the countercurrent passage of air refrigerant stream 26. Stream 18 emerges as stream 19 from heat exchanger 114 and is passed to an expander zone 111, where the pressure and the temperature is reduced to about 4 bar and −135° C., respectively (stream 24). Stream 24 passes through both heat exchangers 101 and 100, respectively. In the heat exchanger 101, the stream 24 provides enough cooling to liquefy the natural gas stream 5 to form liquid natural gas (stream 6). Stream 24 emerges as stream 25 from heat exchanger 101 at a temperature of about −81° C. and it enters heat exchanger 100, where it precools the natural gas (stream 2). Stream 25 leaves the heat exchanger 100 as stream 26 at about −43° C. and 3.7 bar, and is directed to the heat exchanger 114, where this stream precools the countercurrent air stream 18. Stream 26 leaves the heat exchanger 114 as stream 12 and it starts the cycle again.

The air cycle will have a point for make up in order to compensate for air losses in the air cycle. The air make up will have to be treated in treating facilities to eliminate the $CO_2$ and water that it can carry.

Table 4 shows the operating conditions of the main streams of FIG. 3.

TABLE 4

| Stream | P (bar) | T (° C.) |
|---|---|---|
| 2 | 30 | 15 |
| 3 | 29.9 | −69.1 |
| 5 | 29.8 | −68.9 |
| 6 | 29.6 | −130.6 |
| 7 | 1.1 | −159.5 |
| 8 | 1.1 | −159.5 |
| 9 | 1.1 | −159.5 |
| 10 | 1.05 | −80 |
| 11 | 1 | 15 |
| 12 | 3.6 | 36.4 |
| 18 | 43 | 40 |
| 19 | 42.9 | −33.1 |
| 24 | 3.9 | −135.4 |
| 25 | 3.8 | −80.7 |
| 26 | 3.7 | −43.3 |

The invention claimed is:

1. A system of producing Liquefied Natural Gas (LNG) comprising:

(1) an offshore mobile structure, and (2) a natural gas liquefaction plant installed on the offshore mobile structure comprising a closed air refrigeration cycle comprising a point for periodically taking air from the environment in order to compensate for air loss in the refrigeration cycle, wherein the air is treated in order to eliminate water and carbon dioxide from the air prior to entry into at least one air compressor, at least one air compressor where the air from the environment is compressed to obtain compressed air, and wherein the air is re-circulated in the refrigeration cycle, at least one expander where the compressed air is expanded to obtain expanded air, at least one heat exchanger where natural gas is cooled with the expanded air and with an end-flash gas to obtain a cooled natural gas, an expansion device where the cooled natural gas is expanded to obtain an expanded cooled natural gas, an end-flash vessel where the expanded cooled natural gas is separated into liquefied natural gas (LNG) and the end-flash gas.

2. The system according to claim 1, wherein the at least one heat exchanger comprises:

an inlet for receiving compressed air, an outlet for delivering cooled compressed air, wherein the at least one heat exchanger cools the compressed air; and an outlet for air which is further connected to the at least one compressor in a closed refrigeration cycle.

3. The system according to claim 1, comprising at least two heat exchangers, where a first heat exchanger cools the compressed air with expanded air coming from a second heat exchanger to obtain cooled compressed air.

4. The system according to claim 1, further comprising a column for natural gas liquids (NGL) extraction located after the at least one heat exchanger where the cooled natural gas enters, and a natural gas liquids stream and a lean natural gas are extracted.

5. The system according to claim 4, wherein a second heat exchanger is located after the column where the lean natural gas is cooled with the expanded air and the end-flash gas to obtain the cooled natural gas.

6. The system according to claim 1, further comprising a pretreatment plant located prior to the at least one heat exchanger where undesired contaminants or impurities present in the natural gas feed are removed.

7. The system according to claim 1, wherein the mobile structure is a barge.

8. The system according to claim 1, wherein the mobile structure is a ship.

9. A method of production of Liquefied Natural Gas (LNG) on an offshore mobile structure comprising the steps:

a. obtaining environmental air, b. compressing the environmental air to obtain compressed air, c. cooling the compressed air to obtain cooled compressed air, d. expanding the cooled compressed air to obtain expanded air, e. using the expanded air for cooling a natural gas stream to obtain cooled natural gas, and f. expanding the cooled natural gas to obtain expanded natural gas and separating said expanded natural gas into liquid natural gas and an end-flash gas, wherein the end-flash gas is used to cool the natural gas stream, wherein (1) the method is performed in a closed air refrigeration system comprising a point for periodically taking air from the environment in order to compensate for air loss in the refrigeration system; (2) the air is treated in order to eliminate water and carbon dioxide from the air prior to being compressed in step (b); and (3) the environmental air is re-circulated throughout the method.

10. The method according claim 9, wherein step (b.) compressing air is carried out in more than one stage.

11. The method according to claim 9, wherein the expanded air used to cool the natural gas in step (f.) is further compressed.

12. The method according to claim 9, wherein the expanded air used to cool the natural gas in step (f.) is given back to the atmosphere.

13. The method according to claim 9, further comprising the step:

g. separating the natural gas liquids (NGL) before liquefaction.

14. The method according to claim 9, wherein the pressure of the natural gas stream is at least 1 bar.

15. The method according to claim 9, wherein the natural gas is cooled to liquefaction in two stages.

16. The method according to claim 15, wherein the natural gas stream is cooled down in the first stage of cooling to a temperature that allows the extraction natural gas liquids (NGL).

17. The method according to claim 15, wherein the natural gas stream is cooled down, in the second stage of cooling, to a temperature that allows for its liquefaction.

18. The method according to claim 9, wherein the natural gas is pretreated before cooling.

19. The method according to claim 18, wherein the pretreatment of natural gas comprises the removal of at least one of $CO_2$, $H_2S$, $H_2O$, and Hg.

* * * * *